US007857650B1

(12) United States Patent
Wu

(10) Patent No.: US 7,857,650 B1
(45) Date of Patent: Dec. 28, 2010

(54) ELECTRICAL CONNECTOR ASSEMBLY WITH LATCHING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 4 days.

(21) Appl. No.: 12/456,278

(22) Filed: Jun. 15, 2009

(51) Int. Cl.
*H01R 12/24* (2006.01)

(52) U.S. Cl. ..... 439/352; 439/76.1

(58) Field of Classification Search ..... 439/499, 439/468, 473, 76.1, 694, 606, 902, 350–358
See application file for complete search history.

(56) References Cited

U.S. PATENT DOCUMENTS 5,100,342 A * 3/1992 Olsson ..... 439/497
6,808,410 B1 * 10/2004 Lee ..... 439/484
6,971,923 B1 * 12/2005 Wu ..... 439/694
7,207,832 B2 * 4/2007 Liu et al. ..... 439/499
7,261,582 B2 8/2007 Wu
7,601,010 B1 * 10/2009 Wu ..... 439/76.1
2005/0054236 A1 * 3/2005 Shi et al. ..... 439/483

* cited by examiner

*Primary Examiner*—Neil Abrams
*Assistant Examiner*—Phuong Nguyen
(74) *Attorney, Agent, or Firm*—Wei Te Chung; Andrew C. Cheng; Ming Chieh Chang

(57) ABSTRACT

An electrical connector includes an elongated housing having a front portion and a rear portion, a printed circuit board enclosed in the housing, a latching mechanism mounted to the housing. The latching mechanism includes a locking member and actuating member. The locking member includes a retaining portion, a locking portion extending rearwardly from the retaining portion, a ramp connecting to a back edge of the locking portion, the retaining portion engaging with the front portion of the housing. The actuating member includes a plurality of sides surrounding the rear portion of the housing, an inclined pressing tab connecting with a top side of the actuating member and disposed adjacent to the ramp of the locking member. The actuating member is rearwardly pulled to let the pressing tab sliding along the ramp and downwardly pressing the ramp to lower the locking portion of the locking member.

20 Claims, 7 Drawing Sheets

ELECTRICAL CONNECTOR ASSEMBLY WITH LATCHING MECHANISM

BACKGROUND OF THE INVENTION

1. Field of the Invention

The present invention relates to an electrical connector, and more particularly to an electrical connector with a latching mechanism.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8087 defines physical interface and general performance requirements of the mating interface for a Compact Multilane Connector which is designed for using in high speed serial interconnect applications at speeds up to 10 Gigabits/second. The Compact Multilane Connector defined in the SFF-8087 comprises a printed circuit board, a plurality of high-speed cables and low-speed wires respectively electrically connected with the printed circuit board to form a plurality of junctions therebetween, a PVC housing overmolding to the printed circuit board and the cables. The PVC housing comprises a rectangular body portion enclosing the junctions and a pair of tongue portions respectively extending forwardly from the body portion. The front portion of the printed circuit board is exposed between the pair of tongue portions for electrically connecting with a complementary connector. The Compact Multilane Connector also comprises a latching member assembled to a top surface of the body portion of the housing for latching with the complementary connector.

The latching member is pushed downwardly to detach the connector from the complementary connector. However, it may be inconvenient to operate the aforementioned connector, as dimension of the connector is decreased and or limited space for user's hand.

Hence, an improved electrical connector assembly is desired to address the problems stated above.

SUMMARY OF THE INVENTION

An object of the present invention is to provide an electrical connector with a latching mechanism.

To achieve the above object, an electrical connector in accordance with the present invention comprises an elongated housing having a front portion and a rear portion; a printed circuit board enclosed in the housing; a latching mechanism including a locking member and an actuating member, the locking member includes a retaining portion, a locking portion extending rearwardly from the retaining portion, a ramp connecting to a back edge of the locking portion, the retaining portion engaging with the front portion of the housing, the actuating member surrounding the rear portion of the housing and having an inclined pressing tab on a top side thereof disposed adjacent to the ramp of the locking member; a rearward movement the actuating member bringing the pressing tab to slide along the ramp and downwardly press the ramp to lower the locking portion of the locking member.

Other objects, advantages and novel features of the invention will become more apparent from the following detailed description when taken in conjunction with the accompanying drawings.

DETAILED DESCRIPTION OF THE INVENTION

Figure 1:
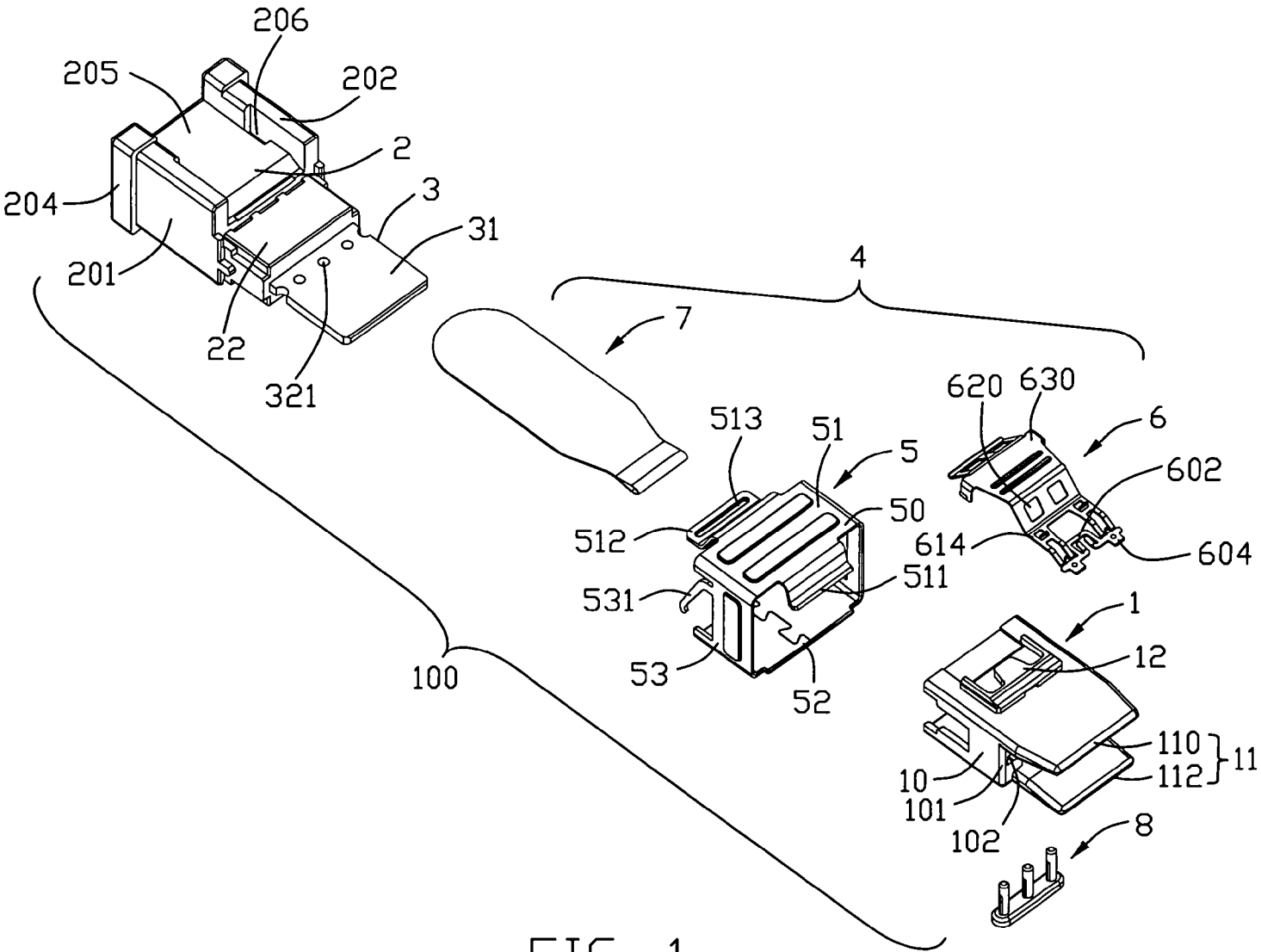
FIG. 1 is an exploded, perspective view of an electrical connector in accordance with a preferred embodiment of the present invention.
Figure 2:
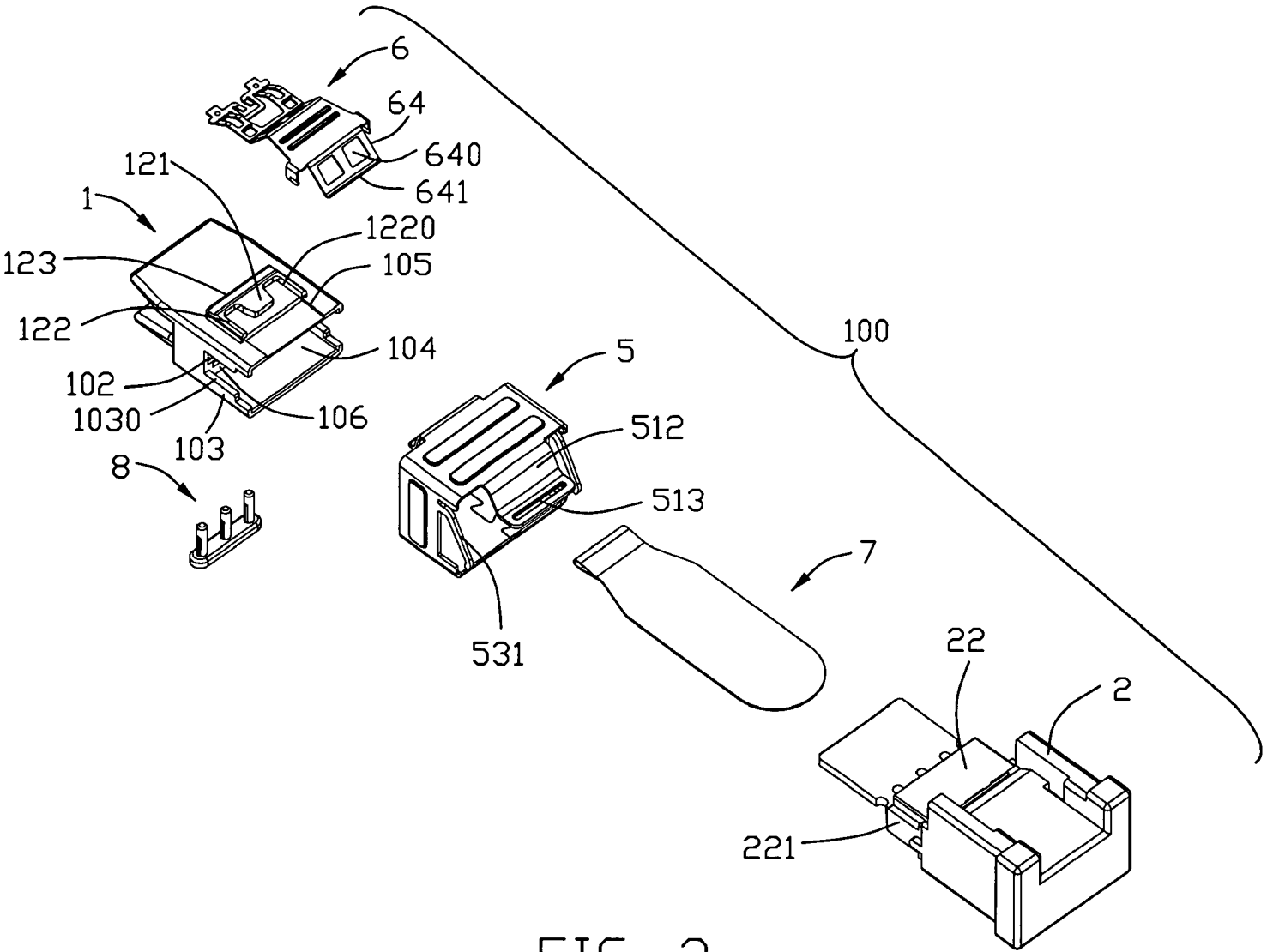
FIGS. 2-3 are views similar to FIG. 1, but taken from different aspects.
Figure 3:
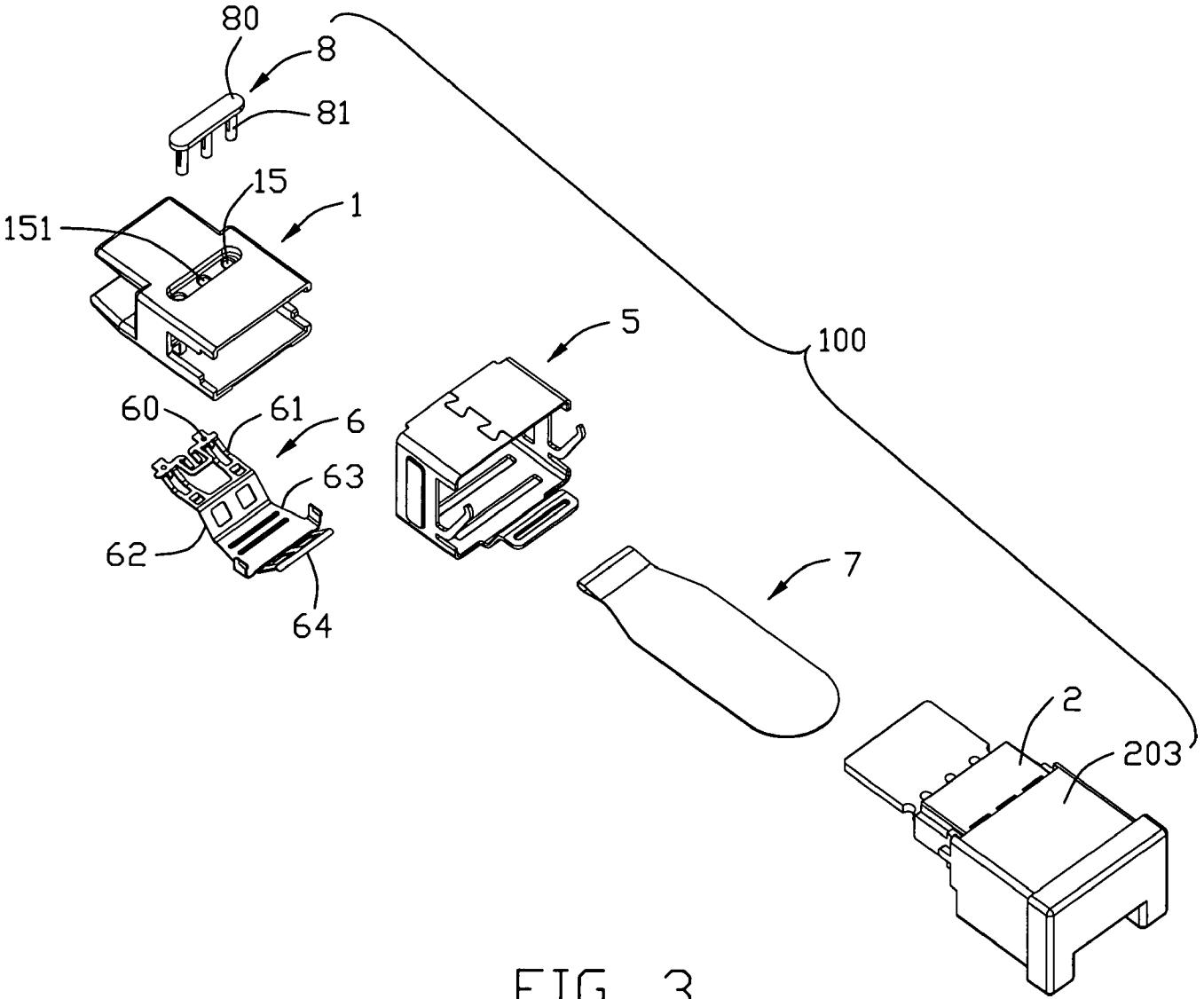
Figure 4:
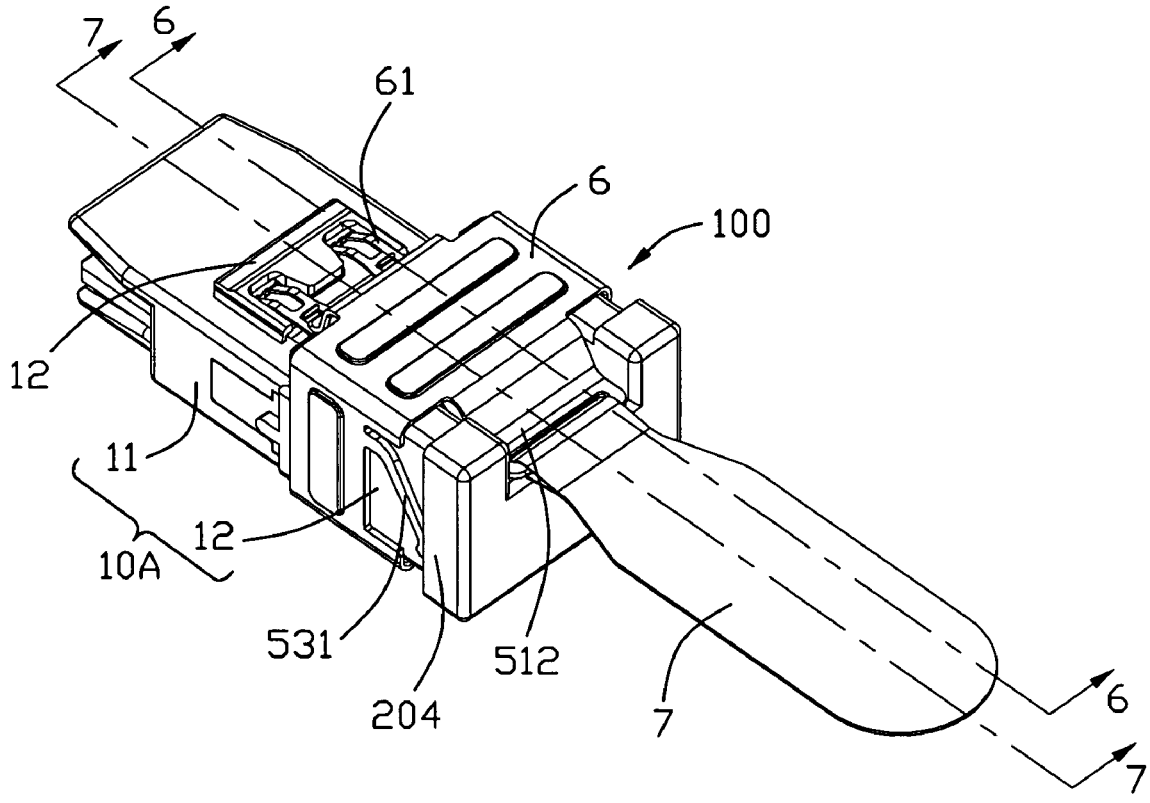
FIG. 4 is an assembled, perspective view of FIG. 2.
Figure 5:
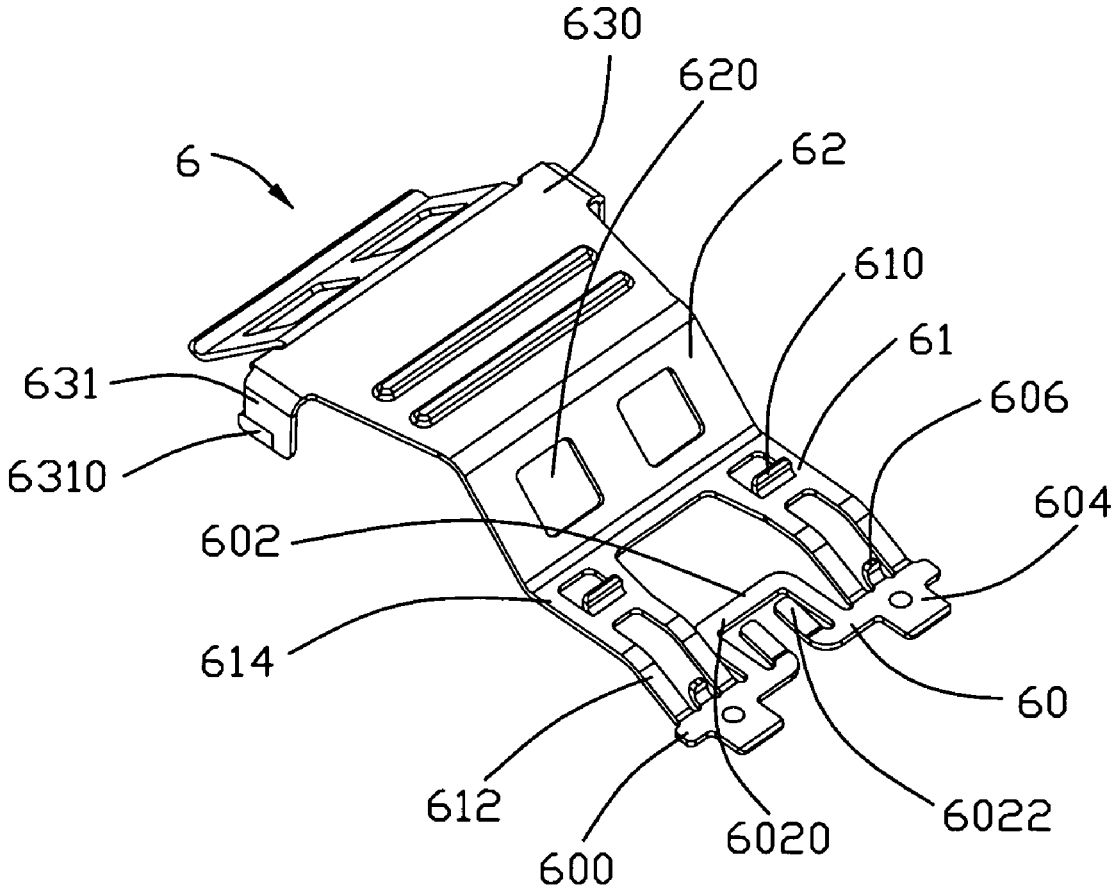
FIG. 5 is an enlarged view of a locking member in FIG. 1.
Figure 6:
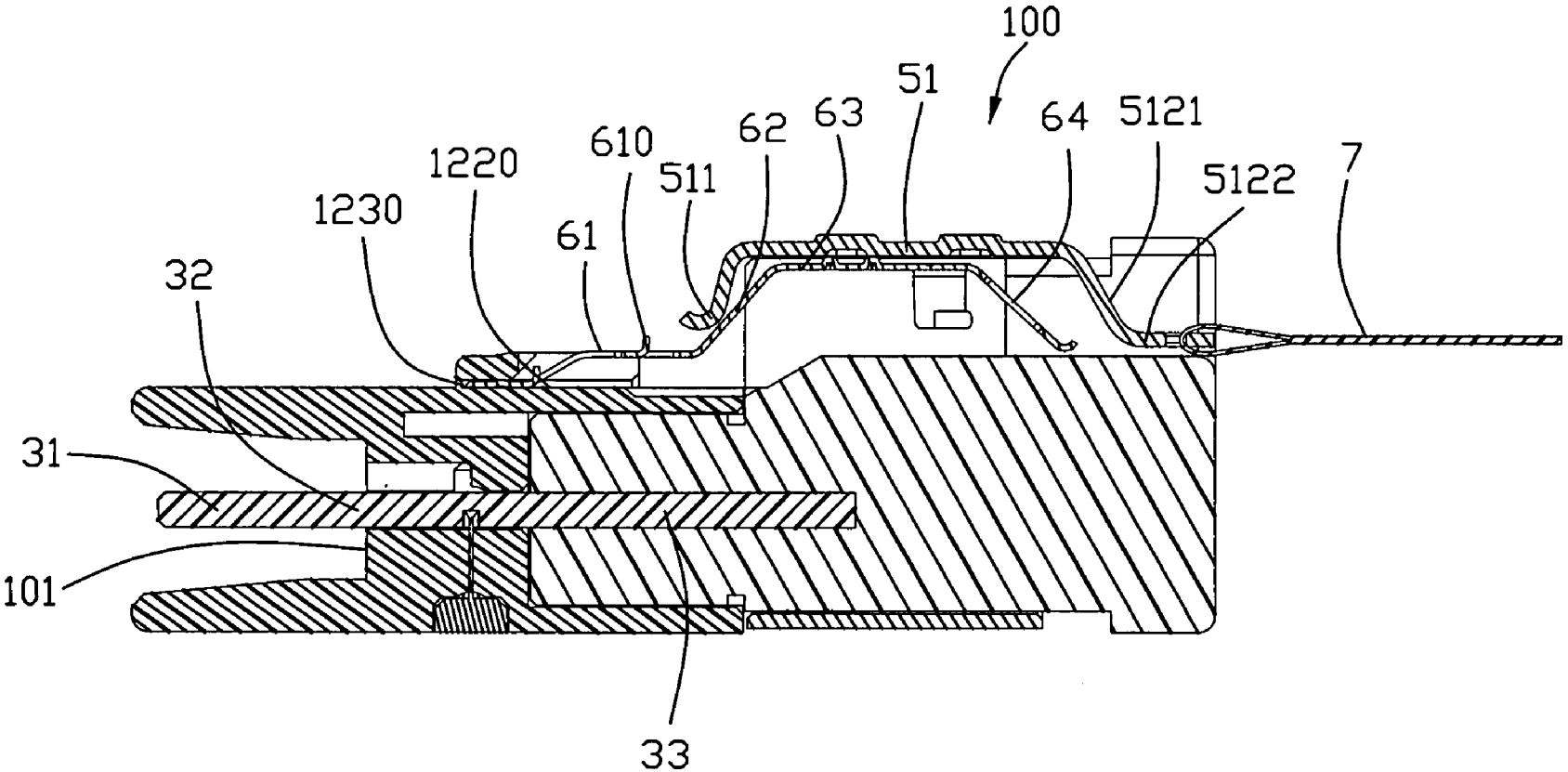
FIG. 6 is a cross-section view of FIG. 4 taken along line 6-6.
Figure 7:
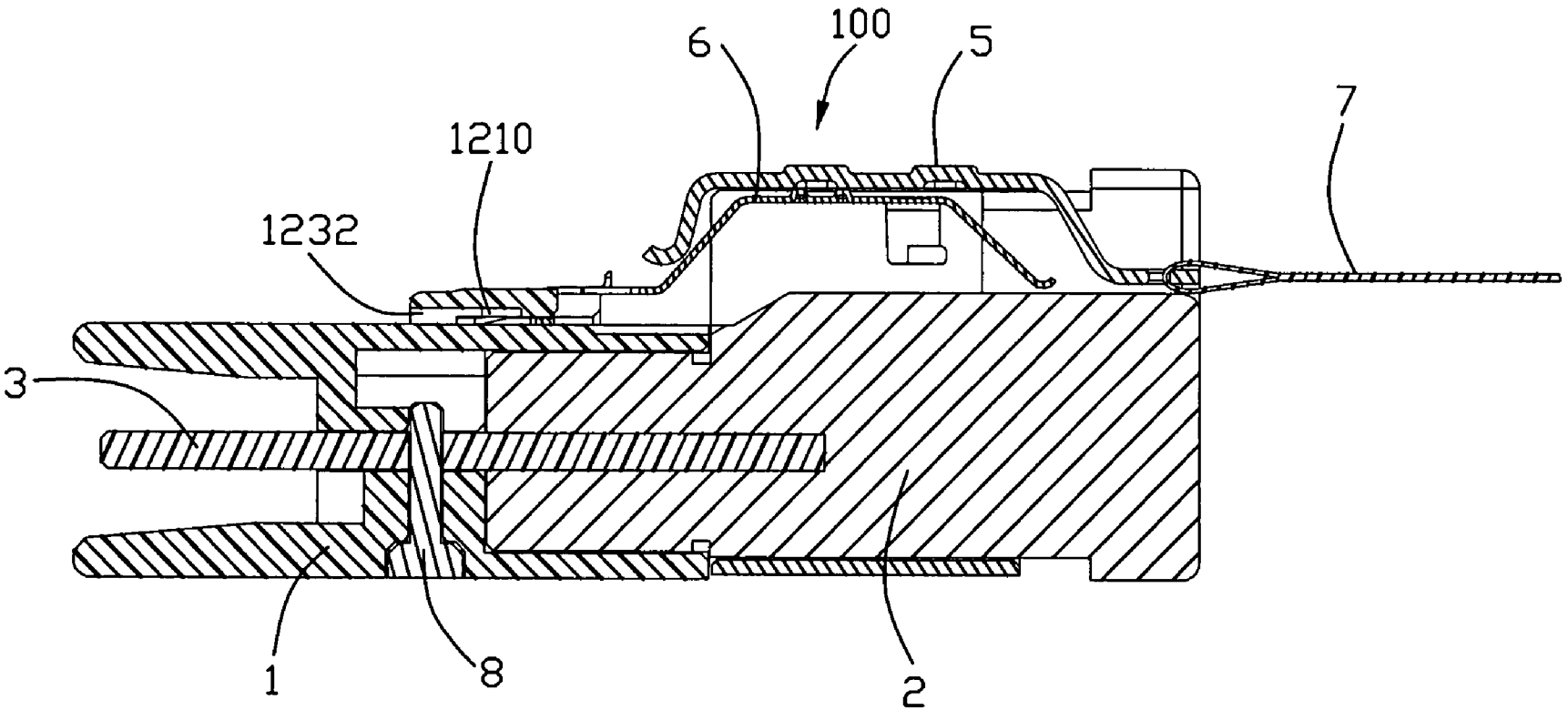
FIG. 7 is a cross-section view of FIG. 4 taken along line 7-7.

Referring to FIGS. 1 to 7, an electrical connector 100 in accordance with the preferred embodiment of the present invention comprises a front (first) housing piece 1 and a rear (second) housing piece 2 forming an elongated housing 10A extending along front-to-back direction, a printed circuit board 3 assembled to the housing 10, and a latching mechanism 4 assembled to the housing 10A for locking with a complementary connector (not shown).

The front housing piece 1 is made of insulative material with enough rigidity or other material, such as metal. The front housing piece 1 includes a rectangular body portion 10 defining a central receiving slot 102 therethrough, and a tongue portion 11 consisting of first and second tongue sections 110, 112 respectively extending forwardly from a front surface 101 of the body portion 10.

The body portion 10 defines a rectangular receiving space 104 recessed forwardly from a rear surface thereof to communicate with the receiving slot 102, and thus, forming an up and bottom walls 105, a pair of lateral walls 103, and a front inner face 106. A cutout 1030 is defined in each lateral wall 103 and communicates with the outmost lateral surface of the lateral wall 103 and the receiving space 104. The receiving slot 102 recesses forwardly from the front inner face 106 to the front surface 101 of the body portion 10 and forms a pair of upper and lower surfaces opposite to each other and perpendicular to the front inner face 106. A positioning cavity 15 is defined in a lower side of the body portion 10, and triple circular holes 151 extend upwardly from a bottom surface of the positioning cavity 15 to respectively communicate with the receiving slot 102.

The body portion 10 forms an M-shape engaging portion 12 on a top surface and adjacent to the rear surface thereof. The engaging portion 12 comprises a protruding section 121 and a pair of arms 122 located at opposite sides of the protruding section 121, all extending rearward from a transverse main section 123. A slit 1210 (FIG. 7) is formed between the protruding section 121 and a top surface of the body portion 10 and extends into the main section 123. A pair of grooves 1220 are respectively formed in the arms 122 and open toward each other. A pair of first slots 1230 and a pair of second slots 1232 located at opposite outer sides of the first slots 1230 are defined in main section 123 to communicate with the slit 1210, respectively.

The rear housing piece 2 of the present invention is made of PVC material. In other embodiments, the rear housing piece 2 also can be made from other material, same as that of the front housing piece 1 or different from that of the front housing piece 1. The rear housing piece 2 comprises a main portion 20 and a forwardly-projecting holding portion 22. Two guiding portions 221 are formed on lateral surfaces of the holding portion 22. The main portion 20 has two lateral sides 201, a top side 202 and a bottom side 203. A flange 204 is formed at rear sections of the two lateral sides 201, the top side 202 and the bottom side 203. A depression 205 is recessed downwardly from the top side 202, and the flange 204 is divided into two part viewed from a top side. Two slots 206 are defined in lateral sides of the depression 205.

The printed circuit board (PCB) 3 has a mating portion 31, a mounting portion 33 and a mediate portion 32. The mating portion 31 extends into a space between the first and second tongue sections 110, 112. The mediate portion 32 is accommodated in receiving slot 102 and the mounting portion 33 is enclosed in the holding portion 22. Three holes 321 is defined in the mediate portion 32 and arranged in a row. The mating portion 31 is adapted for mating with the complementary connector, and the mounting portion 33 is adapted for being terminated with a cable (not shown).

The latching mechanism 4 includes an actuating member 5, a locking member 6 and a pulling tape 7. Both the actuating member 5 and the locking member 6 are stamped and formed from a metallic sheet.

The actuating member 5 has a top side 51, a bottom side 52 and two lateral sides 53 joining with the top side 51 and the bottom side 52. An inclined pressing tab 511 projects forwardly and downwardly from a front edge of the top side 51. A pulling tab 512 is connected to a back edge of the top side 51. The pulling tab 512 includes an inclined part 5121 connected to the back edge and a horizontal part 5122 connected to the inclined part 5121. A slit 513 is defined in the horizontal part 5122. A spring member 531 projects rearwardly and downwardly from a back edge of the corresponding lateral side 53.

The locking member 6 includes a retaining portion 60, a pair of generally L-shape locking portions 61 extending upwardly and rearwardly from the retaining portion 60, a ramp 62 connecting to a back edge of the locking portion 61, a planar mediate portion 63 connecting the ramp 62, and an inclined supporting portion 64 slantwise extending from the mediate portion 63.

The retaining portion 60 has a pair of transverse bar sections 600 respectively connecting with front edges of the locking portions 61, an engaging section 602 connecting with opposite inner ends of the pair of bar sections 600 and extending rearward from the bar sections 600, and a pair of positioning sections 604 respectively extending forwardly from front edges of the pair of bar sections 600. Outmost end of each bar section 600 extends beyond outmost edge of corresponding locking portion 61 and served as guiding means for the locking member 6. The engaging section 602 is located between the pair of locking portions 61 and includes a U-shaped frame 6020 located in a horizontal surface and a pair of elastic snapping sections 6022 extending into the space circumscribed by the frame 6020 with distal ends bending upwardly.

Each locking portion 61 includes an inclined first section 612 extending rearward and upwardly from the retaining portion 60 and a flat second section 614 extending rearward from the first section 612 to connect with the ramp 62. The inclined first section 612 defines a cutout therein for increasing flexibility thereof. The second section 614 is formed with a pair of latching parts 610 extending upwardly and rearward from a back portion thereof. A pair of stop parts 606 are respectively formed with the bar sections 600 and extend into the cutout (not labeled) of the first sections 612 and curve upwardly. The ramp 62 defines a pair of cutouts 620. The mediate portion 63 comprises a body part 630 and a pair of side beams 631 extending downwardly from opposite lateral ends of the body part 630. Each side beam 631 is formed with a tab 6310 extending outwardly therefrom. The supporting portion 64 defines a pair of rectangular openings 640 and forms a curved edge 641 at a free end thereof.

In assembly of the electrical connector 100, the cable (not shown) is soldered to the mounting portion 33 of the PCB 3. The rear housing piece 2 is then over molded to the PCB 3 and the cables 4 with the mounting portion 33 enclosed in the holding portion 22.

The rear housing piece 2 with the printed circuit board 3 is assembled to the front housing piece 1 along the back-front direction. With guiding portions 221 sliding along the cutouts 1030, the mating segment 31 of the PCB 3 and the holding portion 22 inserted into the receiving space 104, then mating segment 31 of the PCB 3 protrudes through the receiving slot 102 to be exposed between the first and second tongue sections 110, 112 until a front surface of the rear housing piece 2 abuts against the front inner face 106 of the front housing piece 1. The through holes 321 of the printed circuit board 3 respectively align with the circular holes 151. In addition, to enhancing the combination of the front and rear housing pieces 1, 2, the present invention also spreads glue to the holding portion 22 before assembling the rear housing piece 2 to the front housing piece 1.

A bolt member 8 includes a head portion 80 and three column portions 82 formed with the base portion 80. The bolt member 8 is assembled to the front housing piece 1, with the column portions 82 respectively protruding through the positioning cavity 15, lower positioning holes 141, through hole 321 of the PCB 32 and into the upper positioning holes (not numbered) of the first housing piece 1, and the head portion 80 received in the positioning cavity 15. Via the bolts 8, the printed circuit board 3 is reliably retained to the front housing piece 1 and has no possibility of being pulled out from the front housing piece 1 when user pulling the cables 4, further enhancing the engagement between the front and rear housing pieces 1, 2.

The locking member 6 is assembled to the front and rear housing pieces 1, 2. The retaining portion 60 slides along the grooves 1220 of the arms 122 of the front housing piece 1, the bar section 600 and the engaging section 602 are received in the slit 1210, the positioning sections 604 and the snapping sections 6022 respectively locked into the first and the second slots 1230, 1232 to prevent the locking member 16 from moving rearwardly when the electrical connector 100 mates with the complementary connector. The pair of stop sections 606 is located in front of the main section 123 for preventing excessive forward movement of the locking member 6. The mediate portion 63 and the supporting portion 64 extend into the depression 205, and the side beams 631 inserted into the slots 206. The tabs 6310 of the side beam 631 elastically engage with inner surfaces of the slots 206 to prevent the locking member 6 from escaping the rear housing piece 2.

The actuating member 5 is assembled to the rear housing piece 2, with the a top side 51, a bottom side 52 and two lateral sides 53 thereof surrounding/enclosing the main portion 20 and capable of sliding along lateral sides 201, a top side 202 and a bottom side 203 thereof. The pressing tab 511 is disposed adjacent to the ramp 62 of the locking member 6, and the pulling tab 512 extends into a rear portion of the depression 205. The spring members 531 press against the flanges 204 to provide a restore force. The pulling tape 7 is tied to the slit 513 of the pulling tab 512.

The complementary connector has corresponding structure locking with the pair of latch sections 610 of the locking member 6 to realize the reliable engagement with the electrical connector 100. When the electrical connector 100 is to be separated from the complementary connector, a rearward pulling force is exerted on the pulling tape 7 to rearwardly move the actuating member 5, then the pressing tab 511 sliding along the ramp 62 and downwardly pressing the ramp 62 to let the locking portion 61 downwardly move, thus, the locking portion 61 is lowered and detached from the corresponding structure of the complementary connector. When the pulling force is withdrawn, the spring members 531 push the actuating member 5 forwardly moving, and the locking portion 61 upwardly move to its original place.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an elongated housing having a front portion and a rear portion;

a printed circuit board enclosed in the housing;

a latching mechanism including a locking member and an actuating member, the locking member includes a retaining portion, a locking portion extending rearwardly from the retaining portion, a ramp connecting to a back edge of the locking portion, the retaining portion engaging with the front portion of the housing, the actuating member surrounding the rear portion of the housing and having an inclined pressing tab on a top side thereof disposed adjacent to the ramp of the locking member;

a rearward movement of the actuating member bringing the pressing tab to slide along the ramp and downwardly press the ramp to lower the locking portion of the locking member;

a pair of tongues extending from the housing;

a spring member rearwardly projects from a back edge of a lateral side of the actuating member and abuts against a corresponding flange formed on the rear portion of the housing;

the locking member further includes a planar mediate portion connected with the ramp and an inclined supporting portion slantwise extending from the mediate portion to sandwich said locking portion therebetween;

the printed circuit board includes a mating portion, a mounting portion and a mediate portion, the mounting portion is combined with the rear portion of housing and extends into a space between the two tongues.

2. The electrical connector as claimed in claim 1, wherein;

the front portion having a pair of lateral walls, and a cutout defined in each lateral walls.

3. The electrical connector as claimed in claim 1, wherein the housing includes a rear housing piece assembled to a front housing piece, the front housing piece includes a body portion and two tongue sections protrude from a front surface of the body portion thereof, the rear housing piece includes a body portion and holding portion projects forwardly from the body portion thereof and into a receiving space defined in a rear segment of the front housing piece.

4. The electrical connector as claimed in claim 3, wherein, the pulling tab of the actuating member extends into the depression.

5. The electrical connector as claimed in claim 4, wherein the front housing piece and the printed circuit board is fastened together by a bolt member.

6. The electrical connector as claimed in claim 1, wherein a depression is defined in a top side of the housing.

7. The electrical connector as claimed in claim 6, wherein the actuating member has a pulling tab connected to a back edge of the top side thereof.

8. The electrical connector as claimed in claim 7, wherein a pulling tape is attached to the pulling tab of the actuating member.

9. The electrical connector as claimed in claim 7, wherein the pulling tab of the actuating member extends into the depression.

10. The electrical connector as claimed in claim 7, wherein the pulling tab includes an inclined part connected to the back edge of the actuating member and a horizontal part connected to the inclined part.

11. The electrical connector as claimed in claim 10, wherein a slit is defined in the horizontal part of the pulling tab to let a pulling tape through therein.

12. The electrical connector as claimed in claim 6, wherein;

the rear portion is made of Polyvinyl Chloride (PVC) material.

13. The electrical connector as claimed in claim 12, wherein the supporting portion protrudes into the depression of the housing.

14. The electrical connector as claimed in claim 12, wherein the supporting portion is enclosed in the actuating member.

15. The electrical connector as claimed in claim 12, wherein a pair of side beams extend downwardly from opposite lateral ends of the mediate portion of the locking member.

16. The electrical connector as claimed in claim 15, wherein the side beams protrude into two slots defined in the depression of the housing.

17. An electrical cable connector assembly comprising:

a housing defining a front portion and the rear portion;

a latching mechanism including a downwardly deflectable locking member and a back and forth moveable actuating member, the locking member positioned upon one of the housing and providing a locking portion, a ramp connecting to the locking portion, the actuating member fully surrounding the rear portion of the housing for assuring retention between the actuating member and the housing, and further enclosing said locking member for avoiding withdrawal of the locking member form the housing, said actuating member defining a pressing tab downwardly pressing and moving along the ramp for lowering the locking portion when said actuating member is pulled rearwardly;

a pair of tongues extending from the housing;

said actuating member is further provided with a spring member to urge the actuating member to move forward;

said spring member is located on a side of said housing which is perpendicular to said face of the housing;

said locking member includes a retention section cooperating with the ramp to sandwich said locking portion therebetween.

18. The electrical cable connector assembly as claimed in claim 17, wherein a slit is defined in the horizontal part of the pulling tab to let a pulling tape through therein.

19. The electrical cable connector assembly as claimed in claim 17, wherein, the actuating member has a pulling tab connected to a back edge of the top side thereof.

20. The electrical cable connector assembly as claimed in claim 19, wherein a pulling tape is attached to the pulling tab of the actuating member.

* * * * *